US012590357B2

(12) United States Patent
Nadendla et al.

(10) Patent No.: US 12,590,357 B2
(45) Date of Patent: Mar. 31, 2026

(54) METHOD FOR CARBIDE DISPERSION STRENGTHENED HIGH PERFORMANCE METALLIC MATERIALS

(71) Applicant: Brunel University London, Uxbridge Middlesex (GB)

(72) Inventors: Hari Babu Nadendla, Uxbridge Middlesex (GB); Xinliang Yang, Uxbridge Middlesex (GB)

(73) Assignee: Brunel University London, Uxbridge Middlesex (GB)

( * ) Notice: Subject to any disclaimer, the term of this patent is extended or adjusted under 35 U.S.C. 154(b) by 582 days.

(21) Appl. No.: 18/007,409

(22) PCT Filed: Jul. 28, 2021

(86) PCT No.: PCT/GB2021/051939
§ 371 (c)(1),
(2) Date: Jan. 30, 2023

(87) PCT Pub. No.: WO2022/023738
PCT Pub. Date: Feb. 3, 2022

(65) Prior Publication Data

US 2023/0287539 A1 Sep. 14, 2023

(30) Foreign Application Priority Data

Jul. 30, 2020 (GB) ..... 2011863

(51) Int. Cl.
*C22C 32/00* (2006.01)
*B22F 3/02* (2006.01)
(Continued)

(52) U.S. Cl.
CPC ..... *C22C 32/0052* (2013.01); *B22F 3/02* (2013.01); *B22F 3/22* (2013.01); *C22C 1/1036* (2013.01);
(Continued)

(58) Field of Classification Search
CPC ..... C22C 1/051; C22C 23/00; C22C 29/067; C22C 32/0052; C22C 1/1036;
(Continued)

(56) References Cited

U.S. PATENT DOCUMENTS 4,180,401 A 12/1979 Frehn
4,194,910 A * 3/1980 Mal ..... C22C 32/0052 75/239
(Continued)

FOREIGN PATENT DOCUMENTS

CN 108500069 A 9/2018
GB 1417261 A 12/1975
(Continued)

OTHER PUBLICATIONS

Hong Wei Zhu et al., Refinement effectiveness of self-prepared (NbTi)C nanoparticles on as-cast 1045 steel, Material and Design, 139, 2018, 531-540.
(Continued)

*Primary Examiner* — Adil A. Siddiqui
(74) *Attorney, Agent, or Firm* — Joseph T. Leone; Yanjun Ma; DeWitt LLP

(57) ABSTRACT

A method of preparing a mixture of a metal or metal alloy and $(Nb_xTi_{1-x})C$ (where $0<x\leq1$) in which $(Nb_xTi_{1-x})C$ in particulate form (either with or without metal powder) is formed into a preform and then if necessary added to the metal. The resulting $(Nb_xTi_{1-x})C$/metal mixture can then be heated to a temperature below the melting point of the $(Nb_xTi_{1-x})C$ and optionally dispersed in liquid metal and/or casted and cooled to produce a solid product with improved physical properties.

18 Claims, 10 Drawing Sheets

(51) Int. Cl.

| | |
|---|---|
| ***B22F 3/22*** | (2006.01) |
| ***C22C 1/10*** | (2023.01) |
| ***C22C 23/00*** | (2006.01) |
| ***C22C 29/06*** | (2006.01) |

(52) U.S. Cl.
CPC ..... *C22C 23/00* (2013.01); *C22C 29/067* (2013.01); *B22F 2201/11* (2013.01); *B22F 2998/10* (2013.01)

(58) Field of Classification Search
CPC ..... C22C 33/0292; C22C 1/05; B22F 3/02; B22F 3/22; B22F 2201/11; B22F 2998/10; B22F 3/10; B22F 3/26; C04B 41/009; C04B 41/4525; C04B 41/88; C04B 35/5611; C04B 38/00; C04B 41/4578; C04B 41/5144; C04B 41/515
See application file for complete search history.

(56) References Cited

U.S. PATENT DOCUMENTS

| | | | |
|---|---|---|---|
| 7,217,311 | B2 | 5/2007 | Hong |
| 7,686,896 | B2 | 3/2010 | Yoshida |
| 8,043,068 | B2 | 10/2011 | Imano |
| 9,017,490 | B2 | 4/2015 | Mannan |
| 9,249,488 | B2 | 2/2016 | Takasugi |
| 2009/0148334 | A1 | 6/2009 | Stephenson |
| 2009/0317622 | A1 | 12/2009 | Huang |

FOREIGN PATENT DOCUMENTS

| | | | |
|---|---|---|---|
| KR | 20100107478 | A | 10/2010 |
| WO | WO 2009/082180 | A2 | 7/2009 |
| WO | WO 2017/173163 | A1 | 10/2017 |

OTHER PUBLICATIONS

International Search Report and Written Opinion dated Nov. 29, 2021, for PCT Application No. PCT/GB2021/051939.

Benjamin, John S. "Dispersion strengthened superalloys by mechanical alloying," Metallurgical Transactions 1, p. 2943-2951 (1970).

Cherepova, T.S., et al. "Wear-resistant alloy for the protection of the contact surfaces of the blades of aircraft engines against oxidation at high temperatures," Nauka Innovats 10 (2014): 22-31.

Huang, S.G., et al. "Stainless steel bonded NbC matrix cermets using a submicron NbC starting powder," International Journal of Refractory Metals and Hard Materials, vol. 63, p. 26-31 (2017).

Rainforth, W.M., et al. "Precipitation of NbC in a model austentitic steel," Atca Materialia, vol. 50, No. 4, p. 735-747 (2002).

Sautereau, J. "Sintering Behaviour of Ultrafine NbC and TaC Powders", Journal of Materials Science, vol. 9, 1974, pp. 761-771.

Woydt, Mathias and Mohrbacher, Hardy. "The tribological and mechanical properties of niobium carbides (NbC) bonded with cobalt or $Fe_3Al$," Wear, vol. 321, p. 1-7 (2014).

* cited by examiner

METHOD FOR CARBIDE DISPERSION STRENGTHENED HIGH PERFORMANCE METALLIC MATERIALS

The present application relates to a method of preparing a preform of $(Nb_xTi_{1-x})C$ where $0<x\leq1$ and to a method of preparing a mixture of a metal or metal alloy and $(Nb_xTi_{1-x})C$ where $0<x\leq1$. More particularly, the present application relates to a method of preparing high performance metallic materials strengthened by ex-situ $(Nb_xTi_{1-x})C$ where $0<x\leq1$ dispersoids.

The method may include the steps of particle synthesis, particle compaction, infiltration of liquid metal into compacted nanoparticle green body, processing of master alloy consisting of concentrated nanoparticles engulfed by magnesium grain, dilution of master alloy to obtain nano-scale dispersions with required particle addition rate and finally casting the melt into final components (e.g. casting, ingot and billets) using practical casting processes to engulf the nanoparticle within the grain for dispersion strengthening. The ex-situ dispersions in the alloy matrix provide improved strength, hardness, stiffness, wear resistance and enhanced corrosion resistance.

Several researchers have reported enhanced properties of metallic materials by particle reinforcement.

U.S. Pat. No. 7,217,311 B2 patent Method of producing metal nanocomposite powder reinforced with carbon nanotubes and the power prepared thereby disclose a powder metallurgy route for producing metal matrix nanocomposite consisting of metallic matrix and carbon nanotubes reinforcement by using the chemical approach for carbon nanotube dispersion. Then the product of metallic oxide particle containing dispersed carbon nanotubes experiences further reduction reaction to obtain magnesium nanocomposites with carbon nanotubes addition.

US 2009/0317622 A1 patent High hardness magnesium alloy composite material describes a high hardness magnesium alloy composites material produced by smelting the nano-sized ceramic aluminium oxide into magnesium liquid. The material normally contains 0.05 wt % to 2.5 wt % of 1 nm to 100 nm sized ceramic particles with considerably increased hardness but excluding significantly increasing weight.

WO 2017/173163 A1 Nanostructure self-dispersion and self-stabilization in molten metals disclose a set of manufacturing methods to incorporate nanoparticles into metallic materials, including magnesium-based nanocomposites with ultrasound treatment assisting the nano particulate dispersion at a volume fraction greater than 3%.

Article "*Dispersion strengthened superalloys by mechanical alloying*" in Metallurgical Transactions (doi.org/10.1007/BF03037835) reported the process of mechanical alloying by high energy ball milling to produce intimately dispersed oxides, uniform internal structure of superalloy. By hot consolidation of the milled powder, long-sought combination of dispersion strengthening and age-hardening in a high temperature alloy is achieved.

Article *Friction and wear of binder-less niobium carbide and The tribological and mechanical properties of niobium carbides (NbC) bonded with cobalt or $Fe_3Al$ in Wear* (doi.org/10.1016/j.wear.2014.09.007) reported the hot pressed NbC bulk and cobalt and $Fe_3Al$ bonded NbC bulk as the cutting tool material through powder metallurgy method and liquid infiltration. The test sample of NbC and/or NbC-binder system presented high hardness and wear resistance.

Article *Precipitation of NbC in a model austenitic steel in Acta Materialia* (doi.org/10.1016/S1359-6454(01)00389-5) reported the existence of strain induced NbC precipitate by the thermomechanical process. Such in-situ formed nano NbC precipitate (~10 nm) is indicated to strengthening the steel through dislocation pinning effect (Orowan strengthening).

U.S. Pat. No. 4,180,401 Sintered steel alloy discloses a sintered steel alloy (based on powder metallurgy) comprising a hard metal compound (carbides) and a matrix alloy of nickel martensitic steel for hot-working tool application. In the patent, the carbides addition was up to 50% and a selection of TaC, ZrC, CrC, VC, NbC and WC. The high hardness of 65-70 Rockwell C is achieved by such steel.

U.S. Pat. No. 7,686,896 B2 High-strength steel sheet excellent in deep drawing characteristics and method for production thereof discloses a high strength steel excellent in deep drawing characteristics and method for production, which uses the strain induced NbC precipitate to further strengthening the steel sheet without sacrificing the isotropic mechanical property in the deep drawing process.

Article *Stainless steel bonded NbC matrix cermets using a submicron NbC starting powder* in International Journal of Refractory Metals and Hard Materials. (doi.org/10.1016/j.ijrmhm.2016.04.021) reported a NbC cermets with ferritic and austenitic stainless steel binders were fully densified by the pressure-less liquid phase sintering. The binder content and thermal treatment allow the adjustment of microstructure and mechanical properties of NbC based hard cermets for cutting tool applications.

U.S. Pat. No. 8,043,068B2 Ni—Fe based super alloy, process of producing the same and gas turbine discloses a Ni—Fe based super alloy, process of producing the same and gas turbine by casting method. The alloy containing 1.5 to 5.0% of Nb and no more than 0.03 wt % C. The in-situ formed nano NbC precipitate is stimulated by the heat treatment after casting process.

U.S. Pat. No. 9,249,488B2 Ni-base dual multi-phase intermetallic compound alloy containing Nb and C, and manufacturing method for same discloses a Ni-based multi-phase intermetallic compound alloy containing Nb and C, and manufacturing method by using NbC addition into the Ni-based melt to obtain Nb and C by the NbC decomposition. The decomposed C and Nb are claimed to be the key factor for the improved mechanical properties at high temperature.

U.S. Pat. No. 9,017,490B2 Ultra high strength alloy for severe oil and gas environments and method of preparation discloses an ultra-high strength alloy for severe oil and gas environment applications and method of preparation with 4.0-6.5 wt % of Nb elements. A ratio of Nb/(Ti+Al) is equal to 2.5 to 7.5 to provide a desired volume fraction of γ' and γ" phases. The extra Nb can tie up with C to form in-situ NbC nanoparticles for further strengthening.

Article *Wear-resistant alloy for the protection of the contact surfaces of the blades of aircraft engines against oxidation at high temperature in Nauka Innovats* 10 (2014): 22-31 reported a ThTN-62 alloy with eutectic composition in a Co—NbC quasibinary cross section, which has in-situ formed NbC as reinforcement and advanced heat resistant properties.

Journal of Materials Science, Vol. 9, 1974, J. Sautereau, "Sintering Behaviour of Ultrafine NbC and TaC Powders", pp. 761-771, discloses the sintering behaviour of NbC and TaC in an Ar or $H_2$ atmosphere, including the compression and sintering of NbC powder to form a pellet.

GB 1417261 (Daido Seiko KK) discloses a process whereby a carbide "reinforcing" layer is formed on a molten metal surface. This forms a ceramic layer on top of the metal with a clear boundary layer between the two layers.

WO 2009/082180 A2 (Seoul National University Industry Foundation) discloses a complete solid solution powder used for preparing a cermet composite sintered body, and method for preparing thereof. Particularly, it is directed to a complete solid solution powder which can improve, to a great extent, toughness of a cermet sintered body which is used for high-speed cutting tool materials and die materials in the field of metal working, such as various machine industries and automobile industry, and method for preparing thereof.

KR 20100107478 A discloses similar subject matter to WO 2009/082180 A2 and is in the name of the same applicant. It requires a step of reducing, carbonizing or reducing, carbonizing and nitriding a mixed powder due to the presence of metal oxides which require a reduction process.

Most of the above methods relating to the magnesium composite materials are based on powder metallurgy route which is industrially difficult to adopt due to higher raw material cost. In the case of melt processing methods mentioned above, it requires additional external fields such as ultrasound treatment or electromagnetic stirring, which again is a cost ineffective process. Most importantly melt processed routes lead to particle agglomeration and segregation to grain boundary area, as shown in FIG. 1(*a*), during solidification which is detrimental to mechanical properties.

In a first aspect of the present invention, there is provided a method of preparing a mixture of a metal or metal alloy and $(Nb_xTi_{1-x})C$ where $0<x\leq 1$, including the steps of:

(Ai) providing $(Nb_xTi_{1-x})C$ in the form of particles, (Aii) mixing the $(Nb_xTi_{1-x})C$ with particles of metal or metal alloy, (Aiii) forming said particles into a preform by compression or by placing said particles into a mould, (Aiv) optionally adding said preform to metal or metal alloy, and (Av) optionally heating said preform to a temperature below the melting point of $(Nb_xTi_{1-x})C$;

or (Bi) providing $(Nb_xTi_{1-x})C$ in the form of particles, (Bii) forming said particles into a preform by compression or by placing said particles into a mould, and (Biii) adding said preform to metal or metal alloy, and (Biv) optionally heating said mixture to a temperature below the melting point of $(Nb_xTi_{1-x})C$ in order to melt the metal or metal alloy.

If said particles are compressed in order to form the preform then the method may include the step of changing the compression applied to the particles in order to result in a preform which includes voids and wherein the void fraction is from 1 to 75%, preferably from 30% to 75% of the preform.

Preferably, x is from 0.01 to 1. More preferably x is from 0.8 to 1, most preferably from 0.9 to 1.

In a preferred embodiment, the preform is formed into a particular shape by forming the preform into said shape, or by including an additional step of removing a part of the preform in order to result in a preform having said shape, or a combination thereof. For example, the preform may be shaped by drilling or machining (or both).

The preform can then be employed in various ways in order to combine the $(Nb_xTi_{1-x})C$ with a metal or metal alloy in order to provide an alloy with superior properties.

TiC is excluded from the scope of this invention by virtue of x being defined as being non-zero. It has been found that pure TiC results in the formation of agglomerates which is disadvantageous.

Advantages of the presence of Ti in the form of $(Nb_x, Ti_{1-x})C$ include:

1. The density of NbC can be decreased, which helps to make the alloy lighter (in addition to the processability advantages already described).
2. The material cost can be lower as Ti is cheaper than Nb.
3. Improved thermal resistance. For example, pure NbC could get oxidised in air at >500° C., whereas TiC has good atmospheric oxidation resistance right up to approximately 1200° C.

The present invention enables the manufacture of metallic materials, in which nanoscale or microscale particles are engulfed by grains, capable of providing superior mechanical properties compared to the monolithic alloys, with scale-up ability and reduced costs as the method is not dependent on the use of conventional external field treatment, powder metallurgy and/or chemical reaction.

It has been discovered that $(Nb_x,Ti_{1-x})C$ has unique and useful properties such as excellent wetting behaviour, self-dispersion, stability of colloidal suspension and spontaneous engulfment during the master alloy manufacturing stage. Moreover, the present inventors have found that the practical casting product manufactured from colloidal solutions retained an excellent uniform dispersion of nanoparticles (dispersoids) inside the grain of magnesium alloys without segregation as shown in FIG. 1(*b*) with improved mechanical properties.

Without wishing to be constrained by theory, it has been found that $(Nb_x,Ti_{1-x})C$ can be used with some metals but not with others. For example, the invention does not work with pure aluminium because the aluminium reacts with the $(Nb_x,Ti_{1-x})C$. Accordingly, in a preferred embodiment the invention is restricted to use with metals/metal alloys that do not react with $(Nb_x,Ti_{1-x})C$. Said metal or metal alloy is preferably magnesium.

It is also thought that the invention works best when the $(Nb_x,Ti_{1-x})C$ is able to wet the metal and therefore be easily dispersible. Wettability can be analysed using Brownian motion (kT) where k is the Boltzmann's constant ($1.3807\times 10^{-23}$ $J\cdot K^{-1}$) and T temperature in Kelvin, and van der Waals attractive forces. One possible factor which influences this is $(Nb_x,Ti_{1-x})C$ particle size. Accordingly, in a preferred embodiment, said particles have an average size from 10 nm to 10 μm.

The method preferably includes the step of changing the compression applied to the particles in order to result in a preform which includes voids and wherein the void fraction is from 1 to 75% (preferably from 30% to 75%) of the preform. The relationship between compression and void fraction is well-known (for example from the field of ceramics) and the skilled person would have no difficulty therefore in controlling the compression in order to achieve a target void fraction.

There is a preferred upper limit of void fraction of 75% of the preform, as above this it is not practically possible to create a preform, due to the lack of physical contact between the particles needed to hold them together as a bulk preform. There is a preferred lower limit of void fraction of 30% of the preform, as below this the particle grains can fuse together and there is a risk of grain growth resulting in poor infiltration and reduced hardening. The presence of a void fraction allows infiltration of liquid metal/metal alloy into the voids to form an infiltrated preform. A sample which is infiltrated within the preferred range (followed by air cooling) exhibits much higher hardness than a sample which is loaded at higher values than the preferred range.

Preferably, the ratio of $(Nb_xTi_{1-x})C$ to metal or metal alloy is controlled to result in an amount of $(Nb_xTi_{1-x})C$ from 1 to 100 wt % of the final product (preferably from 1 to 80%).

In one embodiment in steps (Ai) or (Bi) the $(Nb_xTi_{1-x})C$ particles are mixed with a substance which has a lower melting point than $(Nb_xTi_{1-x})C$. The substance can be an organic binder (e.g Polyvinyl alcohol-PVA), which will be can be dissolved in water and then mixed with carbide powder to produce slurry so that this can be cast into shape and then burn off water and PVA at elevated temperature to obtain the NbC preform.

In the case of Mg alloys, "MAGREX-60" flux can be used to protect Mg alloy melt from oxidation. This could be also mixed with NbC and introduced into liquid Mg.

A mixture of the preform and the metal/metal alloy may be formed by adding said preform to a metal or metal alloy in liquid form at a temperature below the melting point of the preform. Alternatively, the preform may be added to metal or metal alloy in solid form (for example in the form of powder) and the mixture heated to melt the metal/metal alloy.

Alternatively, a preform may be formed including $(Nb_xTi_{1-x})C$ and particles of metal or a metal alloy and said preform may be heated to a temperature below the melting point of said $(Nb_xTi_{1-x})C$ in order to melt said particles of metal or a metal alloy.

The resulting mixture of a metal or metal alloy and $(Nb_xTi_{1-x})C$ may be added to a metal or metal alloy in liquid form and said mixture dispersed in the liquid metal or metal alloy. Alternatively, it may be added to metal or metal alloy in solid form (for example in the form of powder) and the mixture heated to melt the metal/metal alloy. Said dispersed mixture can then be cast in order to form a solid product.

It has advantageously been discovered that the present method enables the formation of a solid solution of metal alloys with nano-particle dispersions within the alloy grain rather than at the grain boundary (see FIG. 1). Furthermore, it has been discovered that such solid solution alloy dispersions have a relationship between the volume fraction of $(Nb_xTi_{1-x})C$ and hardness/stiffness which is close to the theoretical relationship i.e. linear. By contrast, conventional dispersions with nanoparticles at the grain boundary have a non-linear relationship between volume fraction of $(Nb_xTi_{1-x})C$ and hardness/stiffness.

In a further aspect of the present invention, there is provided a method of preparing a preform of $(Nb_xTi_{1-x})C$ where $0<x\leq 1$, including the steps of:

(i) providing $(Nb_xTi_{1-x})C$ in the form of particles, and (ii) forming the particles into a preform.

The particles may be compressed in order to form the preform or the particles may be placed in a mould in order to form the preform.

A number of preferred embodiments of the present invention will now be described with reference to and as illustrated in the accompanying drawings, in which:

FIGS. 1*a* and 1*b* show schematic views of (a) nano-particle segregation to grain boundaries in conventional melt processed metal matrix composites and (b) nano-particle dispersions within magnesium grain rather than at the grain boundary, offering much needed dispersion strengthening by these nanoparticles;

FIG. 2 is an image of a 32 mm diameter pressure-less infiltrated NbC pellet;

FIG. 3 shows a photo of the cross-section of solidified metal of 87.5 vol % Mg-12.5 vol % NbC colloidal solution which shows uniform particle distribution at macroscopic level and the spatial variation of average Vicker's hardness from top to bottom of solidified metal (along the direction of gravitational force). A narrow range of 80 to 93 HV3 hardness value presents a well dispersion of $(Nb_xTi_{1-x})C$ particles FIG. 4 shows a polarised optical microstructure of a hardened billet formed from the master alloy of FIG. 3; the colour contrast represents individual grains;

FIG. 9 (*b*) is an image at a higher magnification than FIG. 9(*a*) showing uniform distribution of $(Nb_xTi_{1-x})C$ for x=1 particles in a Ni-alloy matrix;

FIG. 9 (*c*) is an image showing uniform distribution of $(Nb_xTi_{1-x})C$ for x=0.9 particles in a Ni-alloy matrix.

FIG. 9 (*d*) is scanning electron microscope image and also the chemical elements mapping of Ti, Nb, C, Ni, Cr and Fe elements in the sample. The figure on the top left shows the distribution of $(Nb_xTi_{1-x})C$ for x=0.8 particles in a Ni-alloy matrix.

FIG. 10 (*b*) is a scanning electron microscope image showing uniform distribution of $(Nb_xTi_{1-x})C$ for x=0.9 particles in a steel matrix FIG. 11(*a*) is a scanning electron microscope image showing uniform distribution of $(Nb_xTi_{1-x})C$ for x=1 particles in a Co matrix;

EXAMPLES

Example 1 Synthesis of Solid Solution Particle and Nanoparticle

The starting nominal composition of $(Nb_xTi_{1-x})C$ (for x=0.9, 0.85, 0.8, 0.5, 0.2, 0.1) is blended and compressed and heat-treated in Ar atmosphere at elevated temperature of ~2000° C. with intermediate grinding to obtain solid solution phase.

Figure 1:
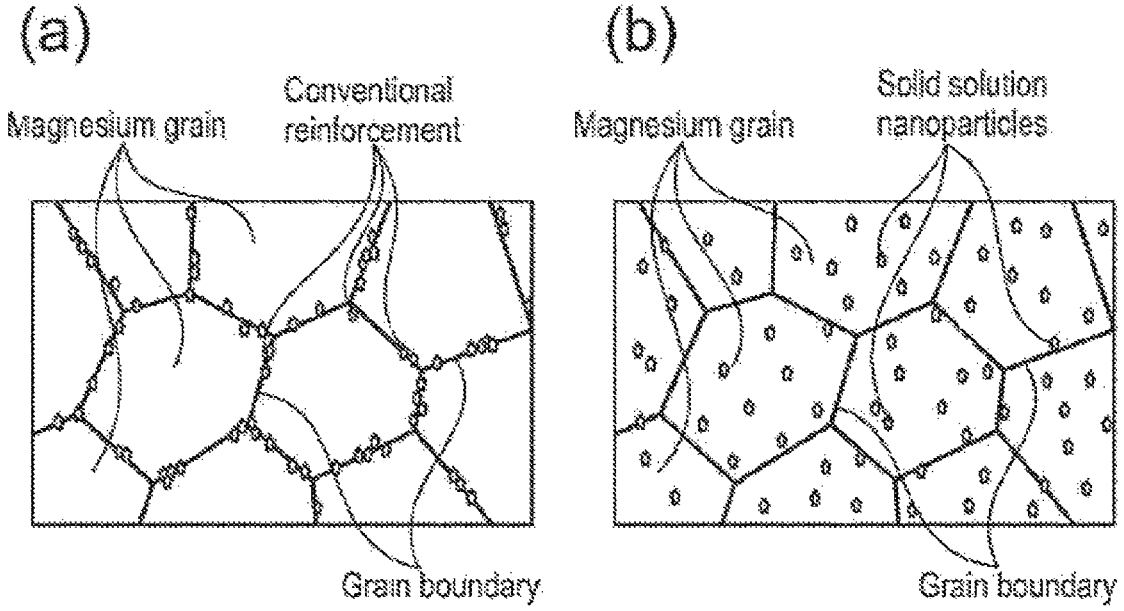
Figure 2:
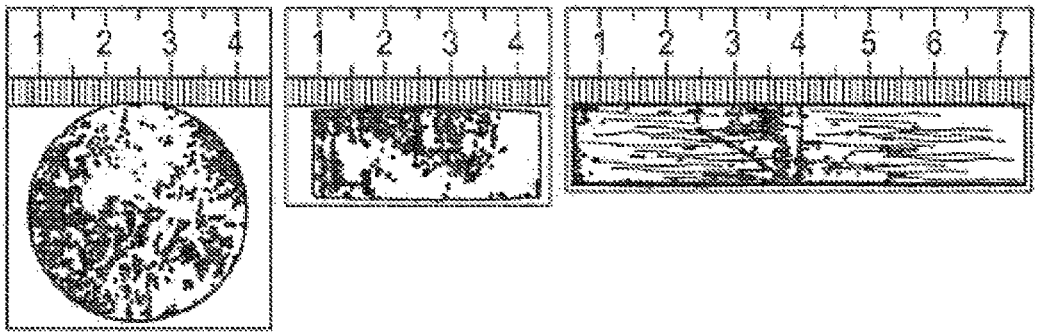

Example 2 Pressure-Less Infiltration into Solid Solution Carbide Pellet with Liquid Magnesium The solid solution particle $(Nb_xTi_{1-x})C$ (for x=1) with particle size range of 300 nm to 2 μm is compressed at 1 ton and 2 ton pressure to produce pellets with 16 mm diameter×5 mm thickness and 32 mm diameter×10 mm thickness, respectively. The green pellets are preheated at 200° C. for 2 hours and placed in liquid Mg at 700° C. Liquid Mg is observed to infiltrate completely into the interior of pellet without any external pressure within 30 min for the 16 mm diameter pellet and 60 min for the 32 mm diameter pellet. Then the infiltrated pellets are cooled in protective atmosphere. The infiltrated 32 mm diameter pellet is shown in FIG. 2. The Vicker's hardness (HV0.1) for infiltrated Mg/$(Nb_xTi_{1-x})C$ (for x=1) pellet have the average of 325 in comparison with reference magnesium matrix of 26.5. The estimate volume fraction of NbC for this infiltrated pellet lies in the range of 50% to 60%.

Example 3 Magnesium-$(Nb_xTi_{1-x})C$ Master Alloy Preparation $(Nb_x,Ti_{1-x})C$ (for x=1) solid solution green pellets of 32 mm diameter×10 mm thickness, with particle size range from 300 nm to 2 μm, is compressed under 1-2 ton uniaxial pressure, preheated at 200° C. for 2 hours and placed in various liquid magnesium alloys, such as commercial pure Magnesium, AZ31 alloy, Elekto21 and AZ91D alloy, for pressure-less infiltration for 1 hour. Then the melt containing the pellets is stirred gently at 500 rpm to break the pellet and disperse the $(Nb_x,Ti_{1-x})C$ particles to obtain well dispersed Mg—$(Nb_x,Ti_{1-x})C$ colloidal solution. With this process, colloidal solutions consisting of different levels of particles were fabricated. After 2 hours holding, these concentrated solutions were cooled under a protective atmosphere to engulf the nano particles by Mg matrix and obtained solid master alloys with different levels of $(Nb_x,Ti_{1-x})C$ particles (Table 1).

TABLE 1

List of Mg master alloys consisting of NbC particles

| Metal | NbC level vol % |
|---|---|
| Magnesium | 3.0 |
| Magnesium | 11.0 |
| Magnesium | 12.5 |
| AZ31 | 2.5 |
| Elektro21 | 3.75 |
| AZ91D | 5.0 |

For some of the samples produced in Example 3, the hardness and elastic modulus have been measured and tabulated in Table 2. This demonstrates that it is possible to produce materials with both high modulus and high hardness.

TABLE 2

The mechanical properties of solid solution reinforced magnesium metal matrix composites.

| | Vicker's hardness HV3 | Elastic modulus GPa |
|---|---|---|
| Mg (reference) | 34.5 | 41.0 |
| Mg + 3 vol % particles | 45.4 | 56.2 |
| Mg + 12.5 vol % particles | 87.0 | 122.5 |

For a magnesium master alloy consisting of 12.5 vol % dispersed $(Nb_x,Ti_{1-x})C$ with x=1, the Vickers hardness is 87.0 HV3 and elastic modulus is 122.5 GPa. For the reference magnesium material, the Vicker's hardness and elastic modulus are measured to be 34.5 HV3 and 41.0 GPa, respectively.

Figure 3:
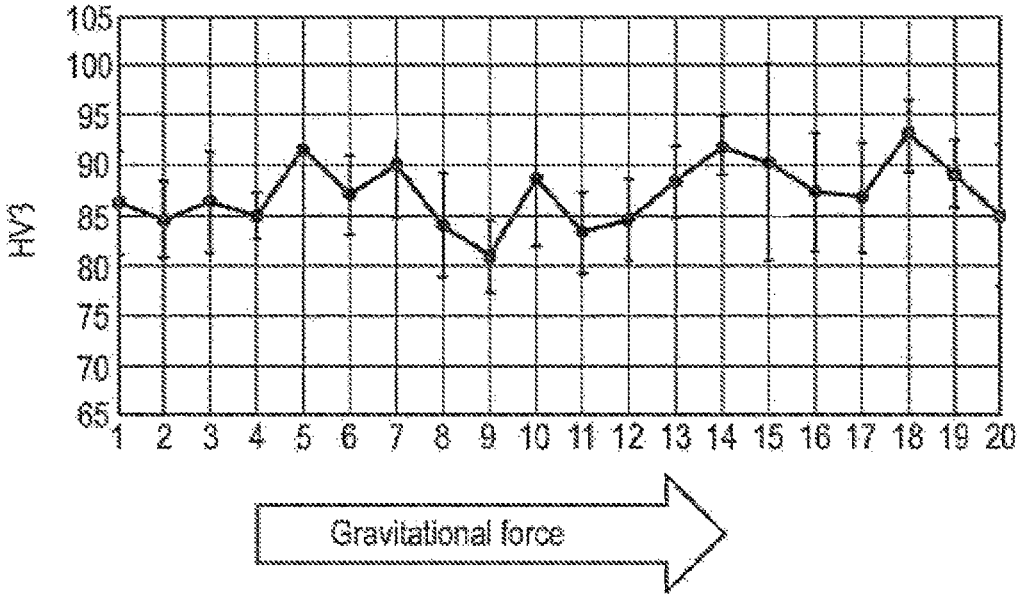
Figure 3:
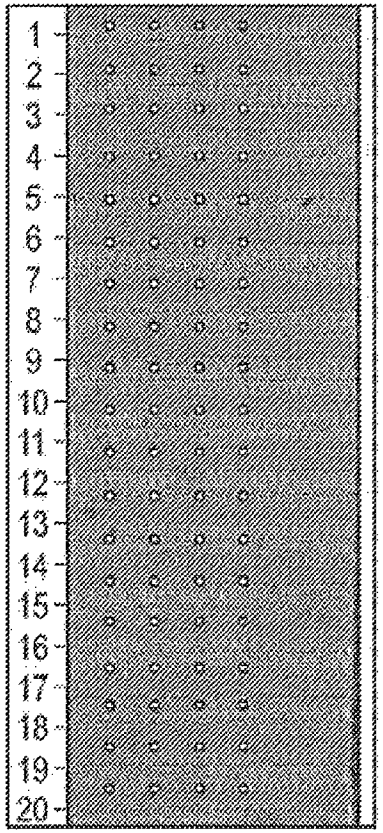
Figure 5:
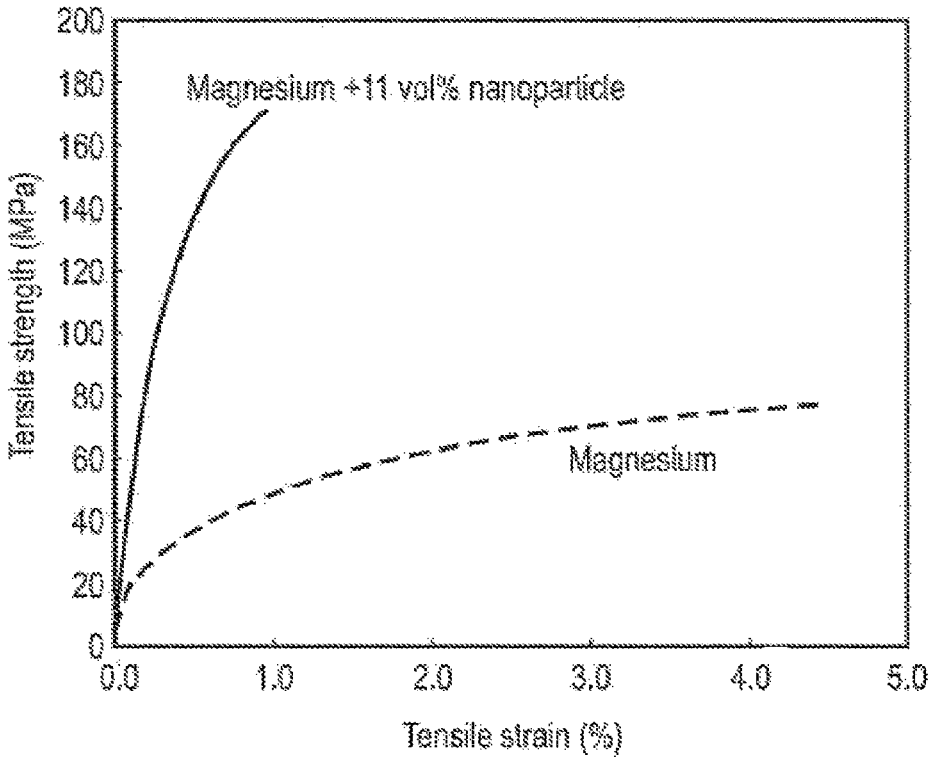
FIG. 5 depicts tensile stress-strain curves of the Mg alone and Mg with 11% NbC master alloy.

The spatial variation of average Vicker's hardness value for 12.5 vol % $(Nb_x,Ti_{1-x})C$ containing master alloy from top to bottom (i.e, along the direction of gravitational force) varied within a narrow range of 87±8 HV3, as shown in FIG. 3. The uniform hardness across the sample suggests lack of particle sedimentation, which further indicates stability of colloidal solution with well dispersed particles in Mg. Similarly, the average Vicker's hardness of 11 vol % $(Nb_x,Ti_{1-x})C$ containing master alloy is 74±8 HV3. For a magnesium master alloy containing 11 vol % dispersed $(Nb_x,Ti_{1-x})C$ with x=1, exhibits a tensile yield strength of 137.8 MPa and ultimate strength of 165.4 MPa, whereas the reference magnesium material in the same condition shows yield strength of 16.4 MPa and ultimate strength of 70.5 MPa. The tensile stress-strain curve is presented in FIG. 5.

Figure 4:
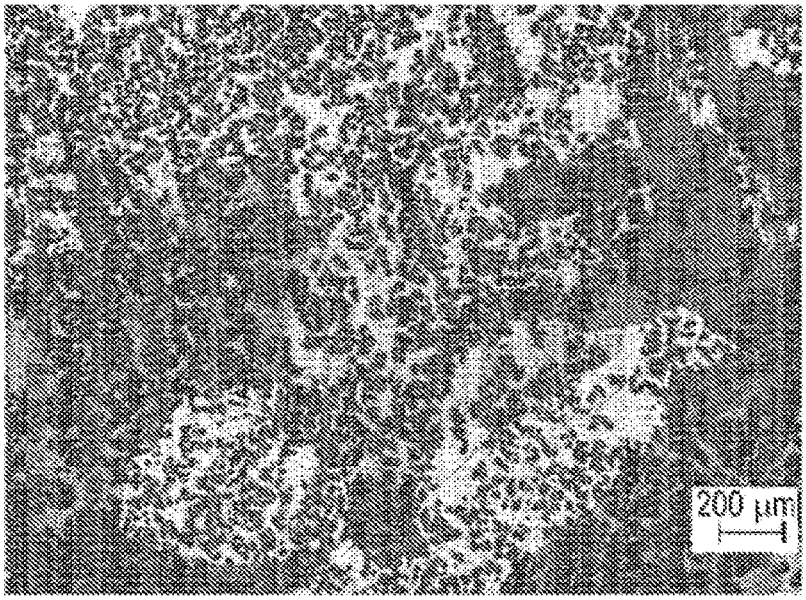

The engulfed particles by Mg grain are also observed to distribute uniformly as shown in FIG. 4. These engulfed particles interact with dislocations and could contribute to significant strength through Orowan strengthening mechanism. The particle engulfment feature seen here is unique to the $(Nb_xTi_{1-x})C$/Mg system compared to conventional magnesium based metal matrix composites produced by conventional casting methods, in which engulfment is much harder to achieve.

Example 4: Method for Preparation of Diluted Mg/$(Nb_xTi_{1-x})C$ Colloidal Solution The master alloy prepared in Example 3 with compositions of (100−y)Mg+y$(Nb_xTi_{1-x})C$, for x=1 and y=5, 11, 12.5 vol % are preheated to 200° C. and added to liquid Mg alloy (AZ91D) for obtaining, 1, 2 and 3 vol % of $(Nb_xTi_{1-x})C$. The melt is protected under SF6+N2 gas flow to avoid oxidation. The melt is gently stirred with a metal rod followed by impeller mixing at 100-200 rpm to ensure mixing without creating turbulence and oxide inclusions. The stability of the colloidal solution with 3 vol % particles has been investigated for 15 mins and 30 mins of holding time. The micro-hardness (HV0.1) across solidified billets is measured at 70±5. The low variation demonstrates the absence of particle sedimentation.

The solutions prepared in this method are fed to various die casting processes such as gravity die casting, twin roll casting and high pressure die casting processes to obtain the final product, in which $(Nb_xTi_{1-x})C$ particles are remained engulfed by the Mg matrix during solidification.

Example 5: Solid Solution Nanoparticle Strengthened AZ91 Alloy

Figure 6:
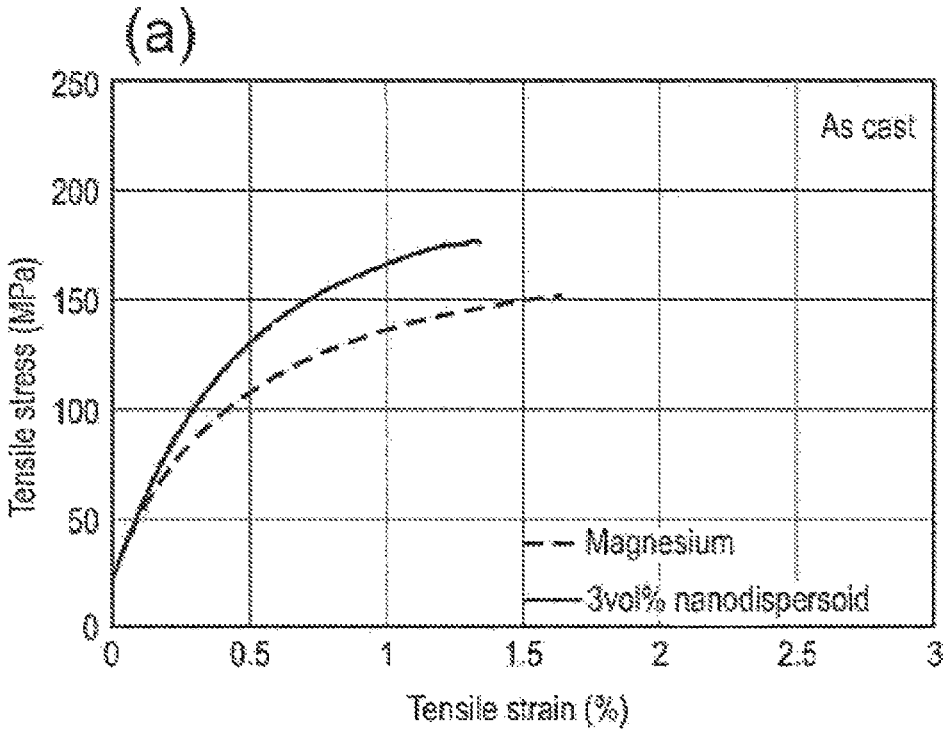
FIG. 6 depicts tensile stress-strain curves of AZ91 alloy and AZ91 alloy with 3 vol % $(Nb_x,Ti_{1-x})C$ particle addition under as-cast and T6 condition.
Figure 6:
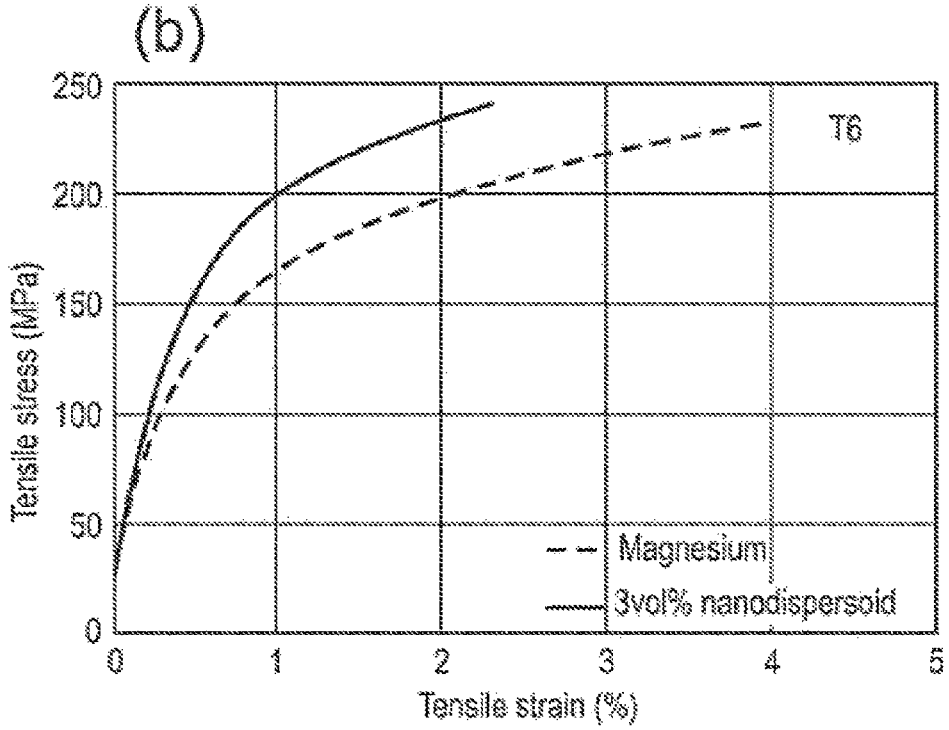

By following the method described in Example 4, 3 vol % solid solution nanoparticles are introduced into liquid AZ91 magnesium alloy (9 wt % Al, 0.8 wt % Zn and 0.2 wt % Mn) to form particle dispersion strengthened AZ91 alloy by diluting the magnesium master alloy containing 12.5 vol % solid solution nanoparticle. The introduced solid solution nanoparticle is of a particle size range of 300 nm to 2 μm and was uniformly dispersed in the AZ91 magnesium alloy matrix. In the as-cast condition, nanoparticle strengthened AZ91 alloy resulted in a tensile yield strength of 125 MPa and ultimate strength of 179 MPa, whereas AZ91 alloy without particle addition reached 102.2 MPa of yield strength and 150.9 MPa of ultimate strength. With T6 heat treatment (i.e. 413° C. for 16 hours and 168° C. for 16 hours)

solid solution nanoparticle strengthened AZ91 alloy had a tensile yield strength of 161.5 MPa and ultimate strength of 240.6 MPa, whereas reference AZ91 alloy reached 129.7 MPa of yield strength and 232.1 MPa of ultimate strength. The stress-strain curves of solid solution strengthened AZ91 alloy and reference AZ91 alloy are presented in FIG. 6.

Example 6: Grain Refinement of AZ31 Magnesium Alloy

Figure 7:
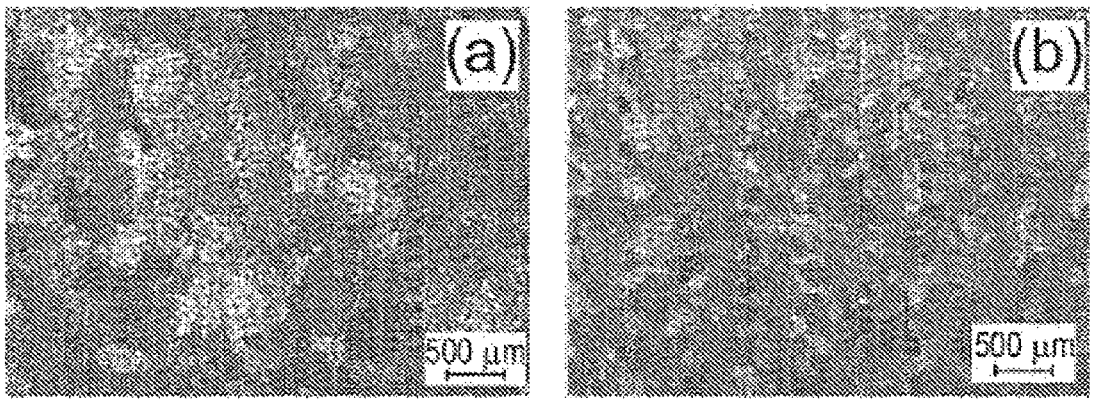
FIG. 7 shows polarised optical microstructures of AZ31 alloy (a) without and (b) with 0.2% NbC particle addition revealing the grain refinement. The colour contrast represents the individual Mg grains.

The NbC particle can also enhance the heterogeneous nucleation of magnesium grain in the solidification process. The AZ31 magnesium alloy has been tested for grain refinement with NbC particle size of 2 μm. For this a master alloy prepared in Example 3 has been added to liquid AZ31 alloy holding at 40° C. super heat and gently stirred manually, after 10 min holding the mixture was cast into a steel mould. The grain size of solid solution particle refined AZ31 is of 198±14 μm and for reference AZ31 it is 464±97 μm. The microstructure is presented in FIG. 7.

Example 7 Fabrication of Dispersion Strengthened AZ91 Containing 3 Vol % $(Nb_{0.85}Ti_{0.15})C$ 3 vol % $(Nb_{0.85}Ti_{0.15})C$ solid solution particles are compressed into pellet (32 mm diameter) under 1 ton load and then introduced into liquid AZ91 magnesium alloy (9 wt % Al, 0.8 wt % Zn and 0.2 wt % Mn). Particles are dispersed in the liquid by gently stirring the liquid magnesium alloy. This colloidal solution is cast into a permanent mould. In the as-cast condition, tensile yield strength of 133.8 MPa and ultimate strength of 172.4 MPa are observed for particle strengthened AZ91 alloy, whereas for AZ91 alloy without particle addition 120.8 MPa of yield strength and 150.9 MPa of ultimate strength are observed.

Example 8: Stiffness as a Function of Amount of $(Nb_xTi_{1-x})C$ Particles

Figure 8:
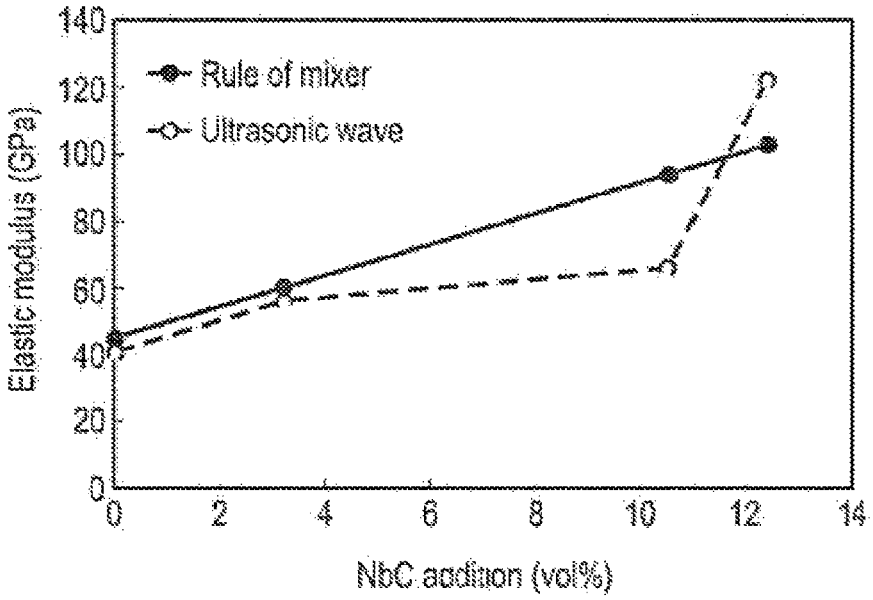
FIG. 8 is a graph of stiffness (elastic modulus) as a function of percentage of added $(Nb_x,Ti_{1-x})C$ to magnesium alloys.
Figure 9A:
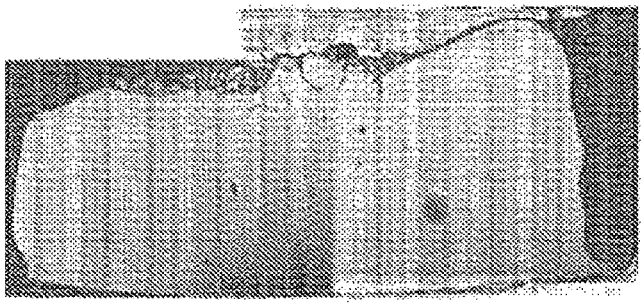
FIG. 9(*a*) is an image showing an $(Nb_xTi_{1-x})C$ for x=1 pellet infiltrated by liquid Ni-alloy in a pressure-less environment.
Figure 9B:
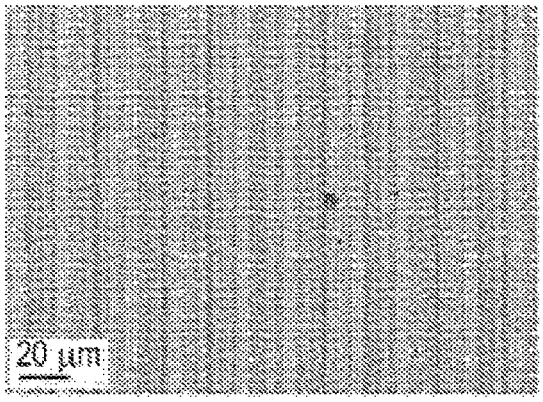
Figure 9C:
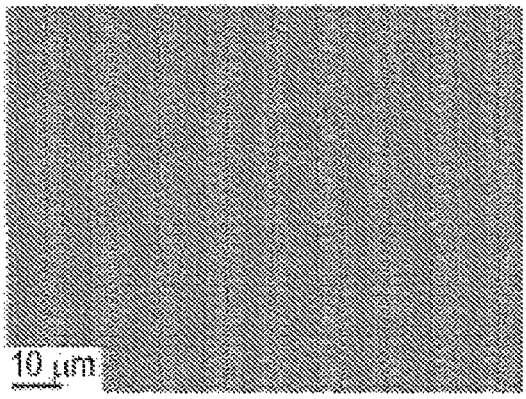
Figure 9D:
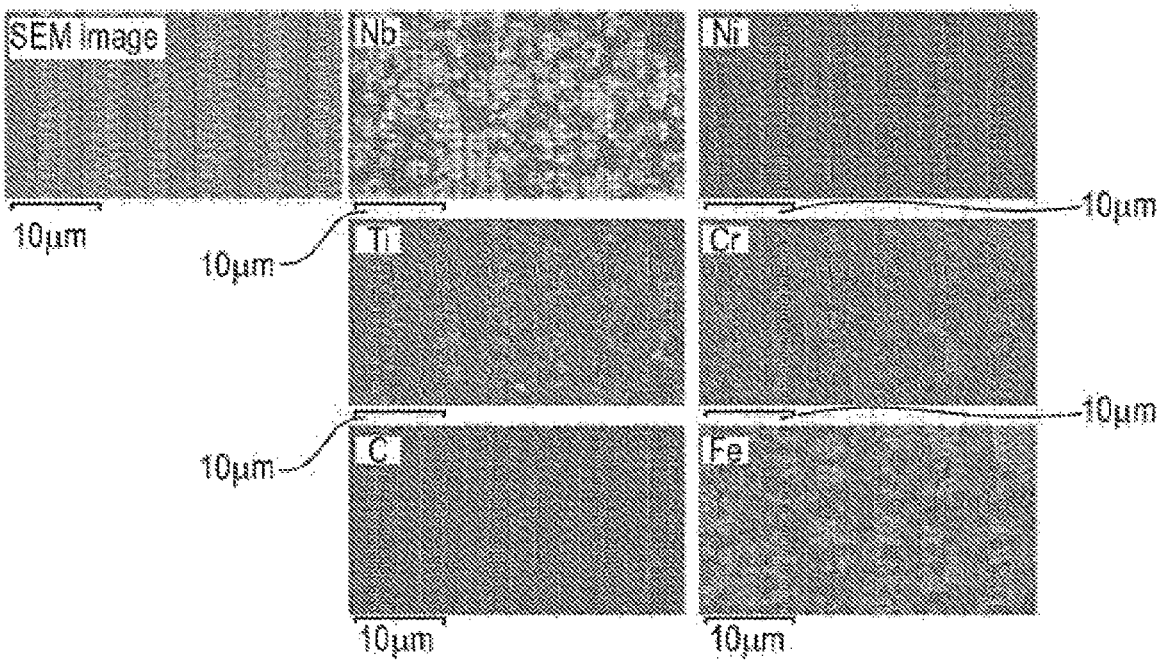

FIG. 8 is a graph showing the elastic modulus of Mg/$(Nb_xTi_{1-x})C$ composite as a function of particle addition (blue line experimental data, red is theoretical). The dispersion strengthened Mg alloys are produced as in Example 3, 4 and 5.

The measured modulus is similar to the predicted values, using rule of mixture concept. In conventional metal matrix composites, the predicted values are very different from the measured ones due to the reinforcement particles' agglomeration and segregation at grain boundaries. If the particles are uniformly distributed within the matrix (as in this invention), then the value linearly increases with volume fraction of particles.

The results in the graph demonstrate that alloys can be designed with varied modulus (stiffness).

Example 9 Strengthening Approach for Nickel-Based Super Alloy by Introducing Compressed Pellet into Nickel-Based Alloy Melt $(Nb_xTi_{1-x})C$ for x=1, 0.9 and 0.8 with an average particle size of about 1.2 micron is compressed at 0.5 ton or 1 ton pressure to produce pellets with 6 mm diameter×1.1 mm thickness. The estimated porosity in the green body is 55% and 49% for 0.5 ton and 1 ton loads respectively. The green body pellets are placed on Ni-based Inconel 718 alloy powder layer in $Al_2O_3$ crucibles.

In 5N purity Ar atmosphere (0.2 l/min flow rate), the temperature is raised to 1450° C. at 3 K/s so that the Ni alloy is in molten state. For each loading condition, the melt is kept for 60 s for one set of samples and 180 s for another set and then cooled to room temperature at 10 K/s. During this period the pellet sinks into liquid metal and the pressure-less infiltration is clearly observed and the $(Nb_xTi_{1-x})C$ pellet is completely wetted by the liquid Ni alloy.

FIG. 9(*a*) shows an electron microscopy image at lower magnification for x=1 and FIG. 9(*b*) shows an image at higher magnification. In FIG. 9(*a*), it can be seen that the liquid Ni infiltrated into the green pellet and filled the porosity in the green body pellet. In FIG. 9(*b*), uniform dispersion of NbC particles within Ni-alloy matrix can be seen. FIG. 9(*c*) shows microstructure of $(Nb_xTi_{1-x})C$ for x=0.9. FIG. 9(*d*) shows chemical elements mapping of alloy consisting of $(Nb_xTi_{1-x})C$ for x=0.8 particles. Coexistence of solid solution $(Nb_xTi_{1-x})C$ phase particles within the Inconel 718 matrix is clearly evident in this chemical mapping analysis.

Example 10 Strengthening Approach for Cast Iron, Tool Steel and Stainless Steel by Introducing Compressed Pellet into Alloy Melt $(Nb_xTi_{1-x})C$ for x=1 and 0.9 with an average particle size of about 1.2 micron is compressed at 0.5 ton or 1 ton pressure to produce pellets with 6 mm diameter×1.1 mm thickness. The estimated porosity in the green body is 55% and 49% for 0.5 ton and 1 ton loads respectively. Green pellets are placed on 316 L alloy powder layer in $Al_2O_3$ crucibles.

In 5N purity Ar atmosphere (0.2 l/min flow rate), the temperature is raised to 1500° C. at 3 K/s so that the 316 L alloy is in molten state. For each loading condition, the melt is kept for 60 s for one set of samples and 180 s for another set and then cooled to room temperature at 10 K/s. During this period the pellet sinks into liquid metal and the pressure less infiltration is clearly observed and the $(Nb_xTi_{1-x})C$ pellet is completely wetted by the liquid alloy.

Figure 10A:
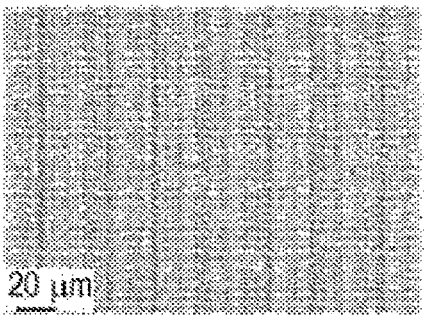
FIG. 10 (*a*) is a scanning electron microscope image showing uniform distribution of $(Nb_xTi_{1-x})C$ for x=1 particles in a steel matrix.
Figure 10B:
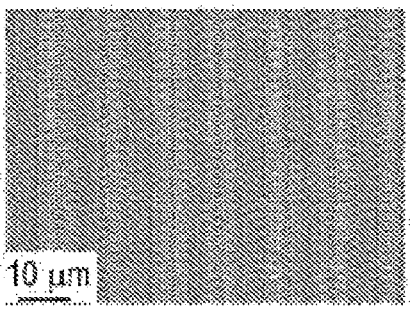

FIG. 10 (*a*) shows an electron microscopy image at higher magnification in which uniform dispersion of $(Nb_xTi_{1-x})C$ for x=1 particles within the steel matrix are clearly visible.

FIG. 10 (*b*) shows an electron microscopy image at higher magnification in which uniform dispersion of $(Nb_xTi_{1-x})C$ for x=0.9 particles within the steel matrix are clearly visible.

Example 11 Strengthening Approach for Cobalt by Introducing Compressed Pellet into Melt $(Nb_xTi_{1-x})C$ for x=1 and 0.9 with an average particle size of about 1.2 micron is compressed at 0.5 ton or 1 ton pressure to produce pellets with 6 mm diameter×1.1 mm thickness. The estimated porosity in the green body is 55% and 49% for 0.5 ton and 1 ton loads respectively. Green pellets are placed on Co powder layer in $Al_2O_3$ crucibles.

In 5N purity Ar atmosphere (0.2 l/min flow rate), the temperature is raised to 1600° C. at 3 K/s so that the Co powder is in molten state. For each loading condition, the melt is kept for 60 s for one set of samples and 180 s for another set and then cooled to room temperature at 10 K/s. During this period the pellet sinks into liquid metal and the pressure less infiltration is clearly observed and the $(Nb_xTi_{1-x})$ pellet is completely wetted by the liquid metal.

Figure 11A:
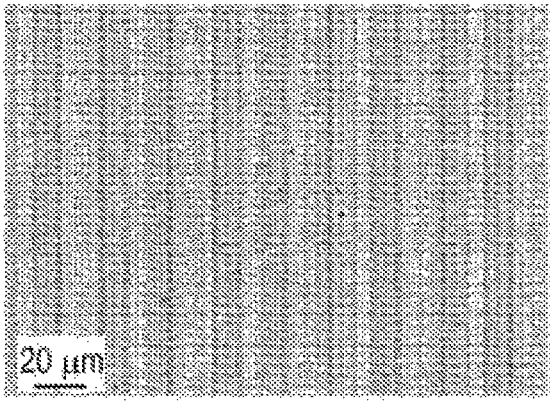
FIG. 11(*b*) is a scanning electron microscope image showing uniform distribution of $(Nb_xTi_{1-x})C$ for x=0.9 particles in a Co matrix
Figure 11B:
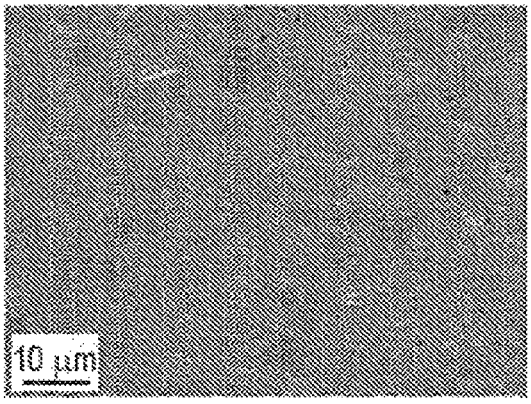

FIG. 11(*a*) shows an electron microscopy image in which uniform dispersion of $(Nb_xTi_{1-x})$ for x=1 particles within Co matrix.

FIG. 11(*b*) shows an electron microscopy image in which uniform dispersion of $(Nb_xTi_{1-x})C$ for x=0.9 particles within Co matrix.

TABLE 3

Vickers hardness ($HV_1$) for Co, 316L and IN718 alloys hardened with NbC

| $HV_1$ | 0 vol % | 45 vol % NbC | 51 vol % NbC |
|---|---|---|---|
| Co | 146.8 | 873.5 | 970.9 |
| 316L | 126.7 | 554.8 | 612.1 |
| In718 | 288.7 | 725.2 | 782.0 |

Example 12 Strengthening Approach for Silver by Introducing Compressed Pellet into Melt NbC with an average particle size of about 1.2 micron is compressed at 0.25 ton to produce pellet with 6 mm diameter×1.1 mm thickness. The estimated porosity in the green body is 55%. The green body (pellet) is placed on Ag powder layer in $Al_2O_3$ crucibles.

In 5N purity Ar atmosphere (0.2 l/min flow rate), the temperature is raised to 1200° C. at 3 K/s so that the Ag powder is in molten state. The melt is kept for 60 s and then cooled to room temperature at 10 K/s. During this period the pellet sinks into liquid metal and the pressure less infiltration is clearly observed and the NbC pellet is completely wetted by the liquid metal.

Figure 12:
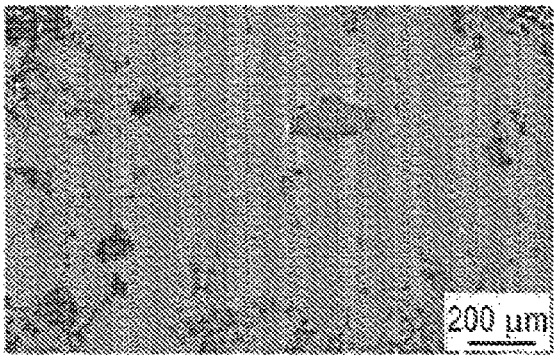
FIG. 12 is a scanning electron microscope image showing NbC particles in a Ag matrix.

FIG. 12 shows an electron microscopy image in which NbC particles within Ag matrix can be seen. The hardness ($HV_{0.1}$) for pure Ag and Ag+36 vol % NbC are 40 and 158, respectively.

Example 13 Strengthening Approach for Aluminium Alloys by Introducing Mg—NbC Master Alloy When NbC is added directly to liquid Al it is observed that the NbC is chemically active with liquid Al and a chemical reaction is observed to occur. To minimise the chemical reaction, the master alloy with 50 wt % Mg-50 wt % NbC composition, prepared by following Examples 2 & 3, has been placed in liquid Al melt.

The melt was held at 730° C. for 2.5 hours and cast into a steel mould. Microstructure of cast sample shows dispersion of NbC particles. The hardness ($HV_{0.1}$) for pure Al is 22 and Al containing NbC are observed to range from 100 to 250 depending on local concentration of NbC content.

Figure 13:
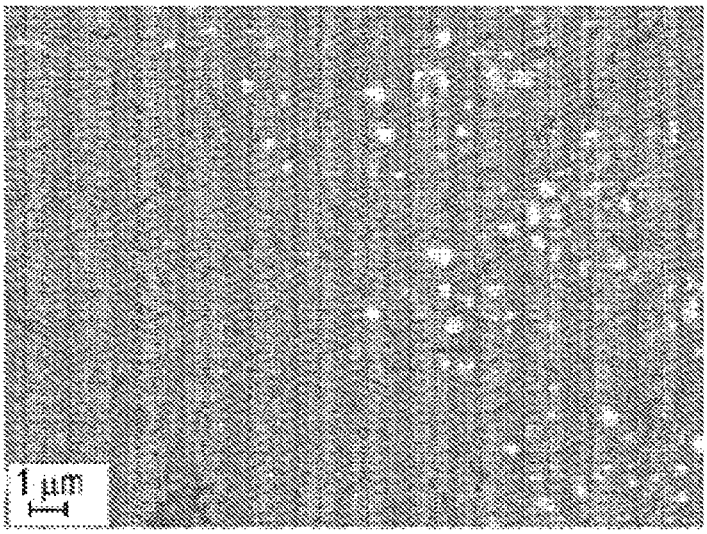
FIG. 13 is an image of a microstructure showing NbC particles in an Al—Mg alloy.

FIG. 13 shows an image of a microstructure showing NbC particles in Al—Mg alloy All optional and preferred features and modifications of the described embodiments and dependent claims are usable in all aspects of the invention taught herein. Furthermore, the individual features of the dependent claims, as well as all optional and preferred features and modifications of the described embodiments are combinable and interchangeable with one another.

The disclosures in UK patent application number 2011863.4, from which this application claims priority, and in the abstract accompanying this application are incorporated herein by reference.

The invention claimed is:

1. A method of preparing a mixture of a metal or metal alloy and $(Nb_xTi_{1-x})C$ where $0<x\leq1$, including the steps of:

(Ai) providing $(Nb_xTi_{1-x})C$ in the form of particles, (Aii) mixing the $(Nb_xTi_{1-x})C$ with particles of metal or metal alloy, (Aiii) forming said particles into a preform by compression or by placing said particles into a mould, (Aiv) optionally adding said preform to metal or metal alloy, and (Av) optionally heating said preform to a temperature below the melting point of $(Nb_xTi_{1-x})C$;

or (Bi) providing $(Nb_xTi_{1-x})C$ in the form of particles, (Bii) forming said particles into a preform by compression or by placing said particles into a mould, and (Biii) adding said preform to metal or metal alloy, and (Biv) optionally heating said mixture to a temperature below the melting point of $(Nb_xTi_{1-x})C$ in order to melt the metal or metal alloy, wherein the method additionally includes the step of adding the resulting mixture of a metal or metal alloy and $(Nb_xTi_{1-x})C$ to a metal or metal alloy in liquid form and dispersing said mixture in the liquid metal or metal alloy; and wherein the method additionally includes the step of casting said dispersed mixture in order to create a master alloy.

2. The method as claimed in claim 1, wherein said particles are compressed in order to form the preform and including the step of changing the compression applied to the particles in order to result in a preform which includes voids and wherein the void fraction is from 1% to 75% of the preform.

3. The method as claimed in claim 1, wherein said particles have an average size from 10 nm to 10 μm.

4. The method as claimed in claim 1, wherein x is from 0.01 to 1.

5. The method as claimed in claim 1, wherein a preform having a desired shape is formed by forming the preform into said shape or by including an additional step of removing a part of the preform in order to result in a preform having said shape, or a combination thereof.

6. The method as claimed in claim 5, wherein the removing step is carried out by drilling or machining the preform.

7. The method as claimed in claim 1, wherein the ratio of $(Nb_xTi_{1-x})C$ to metal or metal alloy is controlled to result in an amount of $(Nb_xTi_{1-x})C$ from 1 to 100 wt % of the final product.

8. The method as claimed in claim 1 wherein the metal or metal alloy in step (Aiv) or (Biii) is in the form of particles or is in liquid form at a temperature below the melting point of $(Nb_xTi_{1-x})C$.

9. The method as claimed in claim 8, wherein the step of adding the preform to liquid metal or liquid metal alloy is carried out in the presence of an inert gas or a reduced partial pressure of oxygen in order to avoid oxidation.

10. The method as claimed in claim 8 wherein the preform has a void fraction of greater than 1% and wherein the liquid metal or metal alloy is infiltrated into said voids.

11. The method as claimed in claim 1, wherein the step of heating said preform to a temperature below the melting point of said $(Nb_xTi_{1-x})C$ is carried out in the presence of an inert gas or a reduced partial pressure of oxygen in order to prevent oxidation.

12. The method as claimed in claim 1 additionally including the step of solidifying the resulting mixture of a metal or metal alloy and $(Nb_xTi_{1-x})C$ by cooling said mixture.

13. The method as claimed in claim 1 wherein the metal of said metal or metal alloy is magnesium, aluminium, cobalt, nickel, silver, iron or steel.

14. The method as claimed in claim 1, wherein in steps (Ai) or (Bi) the $(Nb_xTi_{1-x})C$ particles are mixed with a substance which has a lower melting point than $(Nb_xTi_{1-x})C$.

15. The method as claimed in claim 14, wherein said substance is a polyvinyl alcohol.

16. The method as claimed in claim 1 additionally including the step of adding said master alloy to a metal or metal alloy in liquid form and dispersing said master alloy in the liquid metal or metal alloy.

17. The method as claimed in claim 16 additionally including the step of casting and cooling said dispersed mixture in order to create a solid product.

18. The method as claimed in claim 1 additionally including the step of casting and cooling said dispersed mixture in order to create a solid product.

* * * * *